United States Patent [19]

Fowler

[11] 4,443,795

[45] Apr. 17, 1984

[54] REMOTE INDICATOR FOR DISPLAYING TRANSMITTED DATA BY ANGULAR DISPLACEMENT

[75] Inventor: John T. Fowler, Salem, Mass.

[73] Assignee: The Laitram Corporation, New Orleans, La.

[21] Appl. No.: 96,499

[22] Filed: Nov. 21, 1979

[51] Int. Cl.[3] ..... G08C 19/06; G08C 19/12

[52] U.S. Cl. ..... 340/870.31; 324/140 R; 324/146; 340/870.4

[58] Field of Search ..... 340/870.31, 870.4, 870.33; 33/361, 363 R, 358, 359, DIG. 1; 324/246, 253, 258, 259, 140 R, 115, 144, 146, 151 R, 151 A, 154 R, 154 PB, 167, 173; 318/653, 660, 659, 656

[56] References Cited

U.S. PATENT DOCUMENTS

| | | | |
|---|---|---|---|
| 3,624,625 | 11/1971 | Stonestreet | 340/870.31 |
| 3,671,952 | 6/1972 | Simms | 340/870.31 |
| 3,946,311 | 3/1976 | Baker et al. | 324/140 R |
| 4,030,204 | 6/1977 | Edwards | 33/361 |
| 4,230,984 | 10/1980 | Taylor | 324/140 R |

*Primary Examiner*—James J. Groody

*Attorney, Agent, or Firm*—Weingarten, Schurgin, Gagnebin & Hayes

[57] ABSTRACT

A remote indicator displays data contained in a transmitted signal by angular displacement of a rotor. In essence, the indicator comprises a rotatably mounted magnetic rotor, a plurality of controllable magnetic field generators disposed circumferentially around the rotor, and appropriate selection circuitry. A sector selection circuit responsive to the transmitted data selectively enables at proper polarity a plurality of generators appropriate for controlling the rotor within the sector representative of the data, and an angle selection circuit responsive to the transmitted data alternately drives selected generators by electrical pulses time modulated to drive the rotor within the sector to the angular position representative of the transmitted data. Distortions due to residual magnetism are substantially eliminated by the use of AC pulsing, and non-linear salient pole effects are eliminated through the use of look-up table techniques.

7 Claims, 4 Drawing Figures

REMOTE INDICATOR FOR DISPLAYING TRANSMITTED DATA BY ANGULAR DISPLACEMENT

FIELD OF THE INVENTION

This invention relates to remote indicators for displaying transmitted data; and, in particular, to a remote indicator for displaying data by angular displacement of an indicating rotor.

BACKGROUND OF THE INVENTION

Remote indicators are useful in a wide variety of monitoring applications where it is desired to angularly display measured data at one or more locations remote from the point of measurement. The data can be inherently angular in nature, such as compass bearings, or it can be data, such as pressure, which is related to angular display only by calibration on a circular dial. On a large ship, for example, it may be desirable to transmit and display at several locations, the compass heading determined to a single properly-compensated, highly accurate compass; and where a ship tows a barge or another ship, it is highly desirable to transmit to the towing ship, the leading of the barge or ship being towed.

Typical prior art remote indicators utilize stepping motors with step-driven coils to displace a magnetic indicating rotor. These devices, however, suffer from a number of disadvantages. One such disadvantage is that their accuracy is typically limited by the resolution of the stepping motor. Thus an indicator employing a 7.5° stepping motor is typically limited in accuracy to ±3.75°. Although gearing can be added to reduce the step increments, this technique is considerably less reliable than the direct drive approach utilized in this invention. Higher resolution stepping motors are available, but their cost, complexity and size rise rapidly with increasing resolution.

A second difficulty arises because of residual magnetism. Because the magnetic fields do not completely dissipate upon the withdrawal of current, the motor does not accurately respond to a fast changing signal, introducing errors in accuracy.

Accordingly, it is desirable to provide an economical remote indicator capable of providing more accurate angular display of transmitted data.

SUMMARY OF THE INVENTION

In accordance with the invention, a remote indicator for angularly displaying data contained in a transmitted signal comprises a rotatably mounted magnetic rotor, a plurality of controllable magnetic field generators disposed circumferentially around the rotor, and appropriate selection circuitry. Specifically, sector selection circuitry responsive to the transmitted data selectively enables at proper polarity generators appropriate for controlling the rotor within the sector representative of the data, and angular selection circuitry responsive to the transmitted data sequentially drives the selected generators by electrical pulses time modulated to drive the rotor within the sector to an angular position representative of the transmitted data. Distortions due to residual magnetism are substantially eliminated by the use of AC pulsing, and non-linear salient pole effects are eliminated through the use of look-up table techniques.

BRIEF DESCRIPTION OF THE DRAWINGS

The nature, advantages and various additional features of the invention will appear more fully upon consideration of the illustrative embodiments now to be described in detail in connection with the accompanying drawings.

In the drawings.

DETAILED DESCRIPTION

Figure 1:
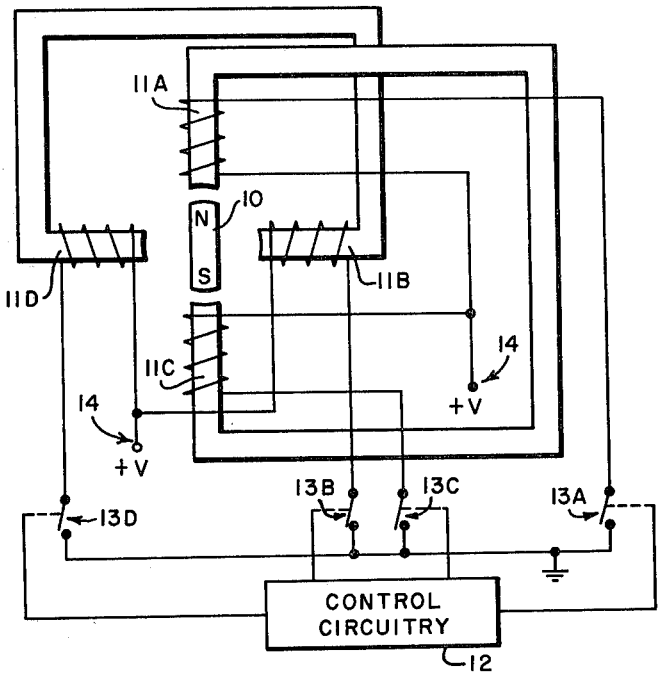
FIG. 1 is a schematic diagram of a preferred embodiment of a remote indicator in accordance with the invention.

Referring to the drawings, FIG. 1 is a schematic diagram of a preferred embodiment of a remote indicator in accordance with the invention. The indicator comprises in essence, a rotatably mounted magnetic indicating rotor 10, a plurality of controllable magnetic field generators 11A, 11B, 11C and 11D disposed circumferentially about the rotor and selection circuitry 12.

The indicating rotor 10, here a single magnet, conveniently comprises an elongated bar magnet having a north pole N and south pole S. The rotor can optionally be affixed to a circular indicating disc if desired (not shown).

The controllable magnetic field generating means preferably comprise four conductive coils disposed about the ends of two magnetically permeable cores, the core ends and coils wrapped thereon being distributed about the circumference of the rotor at substantially 90° intervals. Typically, the magnetically permeable cores are iron cores. The coils are conveniently interfaced with the selection circuitry by a plurality of electronically controllable switches 13A, 13B, 13C and 13D electrically connected between respective coils and a power source 14, such as a dry cell. Closure of switch 13A, for example, activates the iron core establishing opposite field polarities in opposing core ends 11A and 11C. The opening of switch 13A and closure of switch 13C results in the reversal of the flux direction in field generating core ends 11A and 11C.

The selection circuitry 12 basically comprises logic circuitry for receiving a digital angular data input signal typically representing an angle between 0° and 360°, activating a plurality of coils at proper polarity for driving the rotor to the appropriate sector (quadrant in this embodiment) and sequentially applying width-modulated electrical pulses to the selected coils for driving the rotor to the appropriate angle. Preliminary circuitry can optionally be added to convert analog input signals to digital signals and to calibrate non-angular data, such as pressure or temperature, to an angular representation, in accordance with techniques well known in the art.

Preferably the selection circuitry comprises a microprocessor including logical decision means, memory means and register means such as an Intel 8048 military specification microprocessor.

Figure 2:
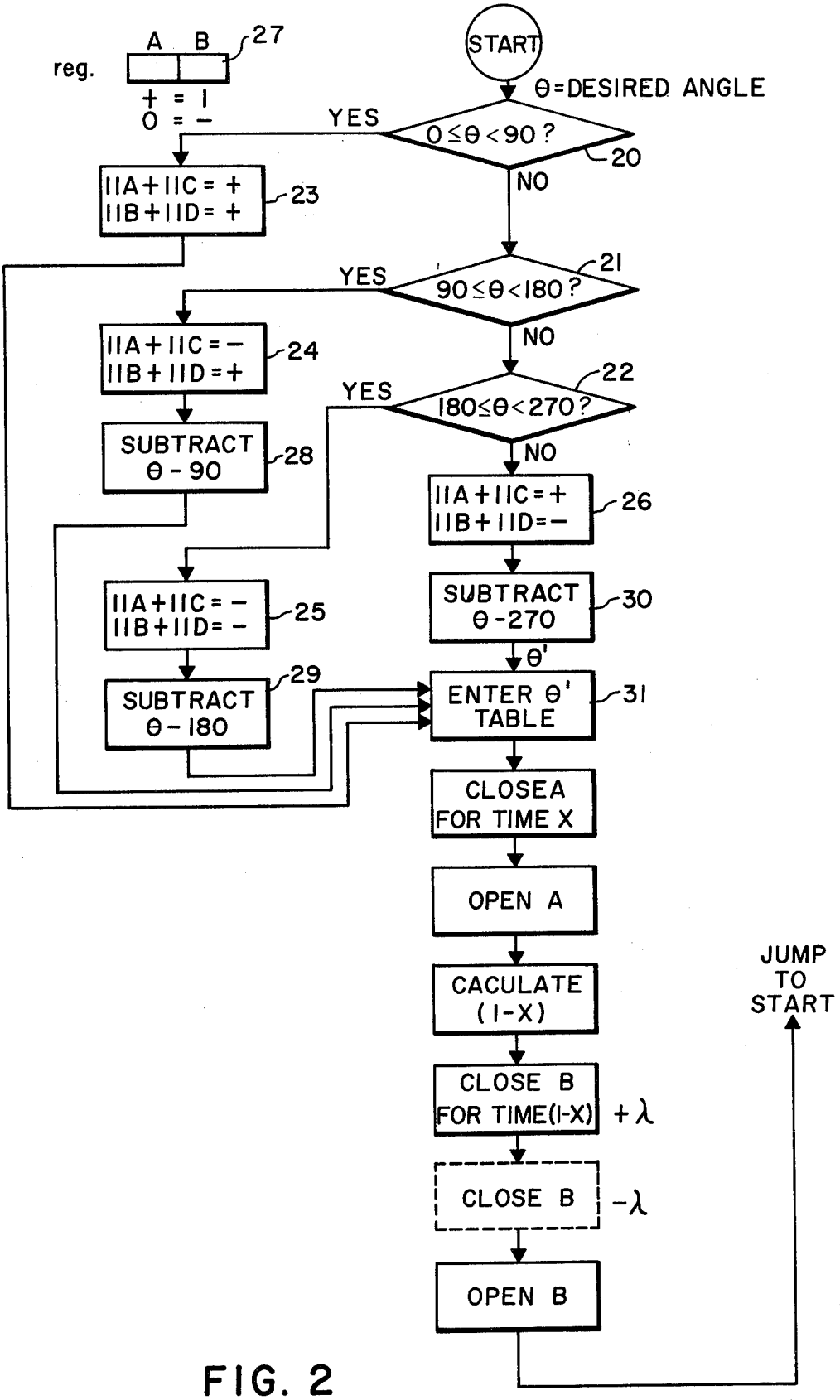
FIG. 2 is a flow diagram showing the operation of the preferred logical selection circuitry for the embodiment of FIG. 1.

The operation of the embodiment of FIG. 1 can be understood by reference to FIG. 2 which is a flow diagram showing the operation of the logical selection circuitry.

The logical decision means, represented by decision boxes 20, 21 and 22, comprises logical circuit means for analyzing the angular input data and determining which of the four quadrants contain the designated angle.

The memory means, represented by look-up tables 23, 24, 25 and 26, comprise means for storing for each of the four quadrants, command data for commanding activation of the magnetic field generating means appropriate for displacing the rotor into the selected quadrant. The command data can conveniently comprise a pair of binary words for commanding closure of selected ones of electronic switches 13A, 13B, 13C and 13D so as to obtain positive or negative polarity energization of generators 11A, 11B, 11C and 11D, respectively. Storage register means 27 are conveniently provided for temporary storage of the selected command data.

Typical binary values of energization of the field generators for different representative angles are given below:

TABLE 1

| ANGLE | 11A | 11B | 11C | 11D |
|---|---|---|---|---|
| 0 | 1 | 0 | 1 | 0 |
| 90° | 0 | 1 | 0 | 1 |
| 180° | −1 | 0 | −1 | 0 |
| 270° | 0 | −1 | 0 | −1 |

Arithmetic means, represented by subtraction boxes 28, 29 and 30, are provided for calculating the acute angle between the angular representation of the data and a pre-selected base angle for each quadrant. Thus using the minimum angle of each quadrant as a base angle, 90° is subtracted from data angles in the second quadrant, 180° from angles in the third quadrant and 270° from angles in the fourth quadrant, respectively, to calculate the residual acute angle $\theta'$.

Additional memory means in the form of look-up table 31 is provided for storing for each one of a plurality of angular increments of $\theta'$ between 0° and 90°, the switch closing time intervals for driving the rotor to that residual acute angle $\theta'$ within a quadrant. These timing intervals are conveniently empirically determined as relative percentages of a fixed timing interval to be applied to switches 13A, 13B, 13C or 13D.

Typical field energization periods (as decimal fractions of the fixed timing interval) and polarities for different representative acute angles are listed in Table 2, below:

TABLE 2

| ANGLE | 11A | 11B | 11C | 11D |
|---|---|---|---|---|
| 45° | (0.5)(1) | (0.5) (1) | (0.5) (1) | (0.5) (1) |
| 135° | (0.5) (−1) | (0.5) (1) | (0.5) (−1) | (0.5) (1) |
| 225° | (0.5) (−1) | (0.5) (−1) | (0.5) (−1) | (0.5) (−1) |
| 315° | (0.5) (1) | (0.5) (−1) | (0.5) (1) | (0.5) (−1) |

In operation, the microprocessor loads the timing interval for switches 13A or 13C into the timer. The signal from the timer closes switches 13A or 13C, and the microprocessor goes into an idle mode while the timer counts down. When the timer times to zero, it generates an interrupt which loads the remainder of the fixed timing interval into a timer for switches 13B or 13D. Thus the switches sequentially energize the coils for maintaining the rotor within the selected quadrant. This sequential energization of switch pairs can be effected by using a set-reset flag and changing the flag with each timing-out interrupt.

The coils should be sequentially activated at a rate much higher than the rotor can respond so that that the rotor acts as an integrator and oscillates within an intermediate position as if the coils were simultaneously energized. The pulse durations can be conveniently chosen so that the oscillations will be substantially unobservable to the human eye while being sufficient to overcome any static friction in the rotor mounting. Pulse repetition rates in excess of about 10 hertz demonstrate this quality.

The advantage of using a look-up table with empirically determined pulse duration values is that accurate indicator positioning is thus obtained despite inherent non-linearities in the field strength versus displacement response of the coils. In a preferred embodiment, the pulse durations are empirically determined and stored for each quarter-degree interval.

To obtain even higher levels of accuracy, the drive circuitry can be designed to effect a "positive zeroing" of coils when it is desired to shift a magnetic generator from a high value to a substantially zero value. In such shifts the pole tends to retain a residual magnetization which introduces errors in accuracy. This source of inaccurancy can be substantially eliminated by including an additional command in the look up table 31 for acute angles requiring a low level of energization for one or more coils. Instead of commanding a zero current, the command can apply a high frequency AC signal so as to produce cancelling effects on the rotor.

The single magnet indicator of FIG. 1 is an absolute device in that the rotor has a unique magnetic orientation for every angle between 0° and 360°. In alternative forms of the invention employing multiple-magnet rotors, magnetic symmetries can be introduced which produce ambiguities, and in such instances the indicator should be modified to include some type of indexing means.

Figure 3:
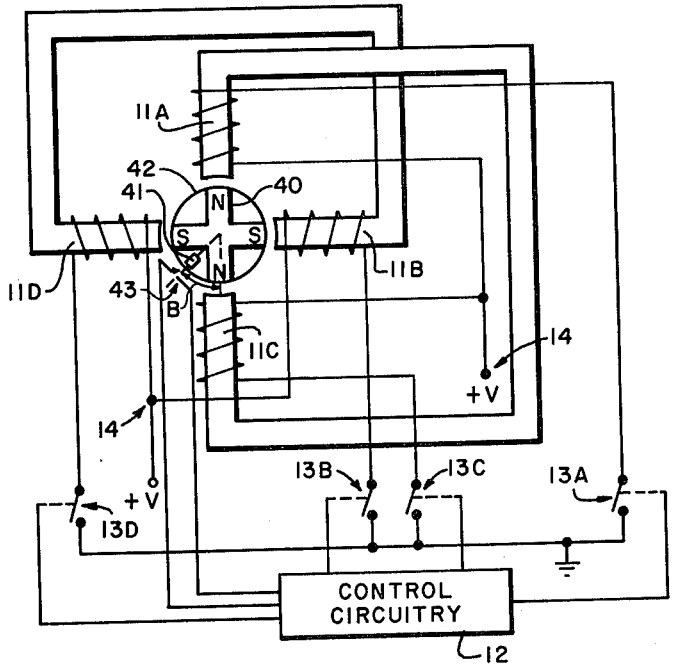
FIG. 3 is a schematic diagram of an alternative embodiment of a remote indicator utilizing a multiple-magnet rotor.

FIG. 3 illustrates an alternative form of the invention employing a multiple magnet rotor and indexing means. Specifically, a four-pole rotor 40 and indexing means in the form of an indexing magnet 41 are mounted in fixed relation to one another on rotatably mounted calibrated disc 42. The index is mounted at a displacement angle, B, here 15°. An index sensing device, such as reed switch 43, is mounted adjacent the periphery of the disc in order to sense passage of the index point and generate a signal indicative of such passage.

It will be readily appreciated that the rotor 40 possesses an axis of magnetic symmetry as indicated in the figure and that, in the absence of indexing means, the rotor would exhibit substantially the same magnetic configuration for rotational positions 180° apart, producing a 0°–180° ambiguity in the indicated value.

Figure 4:
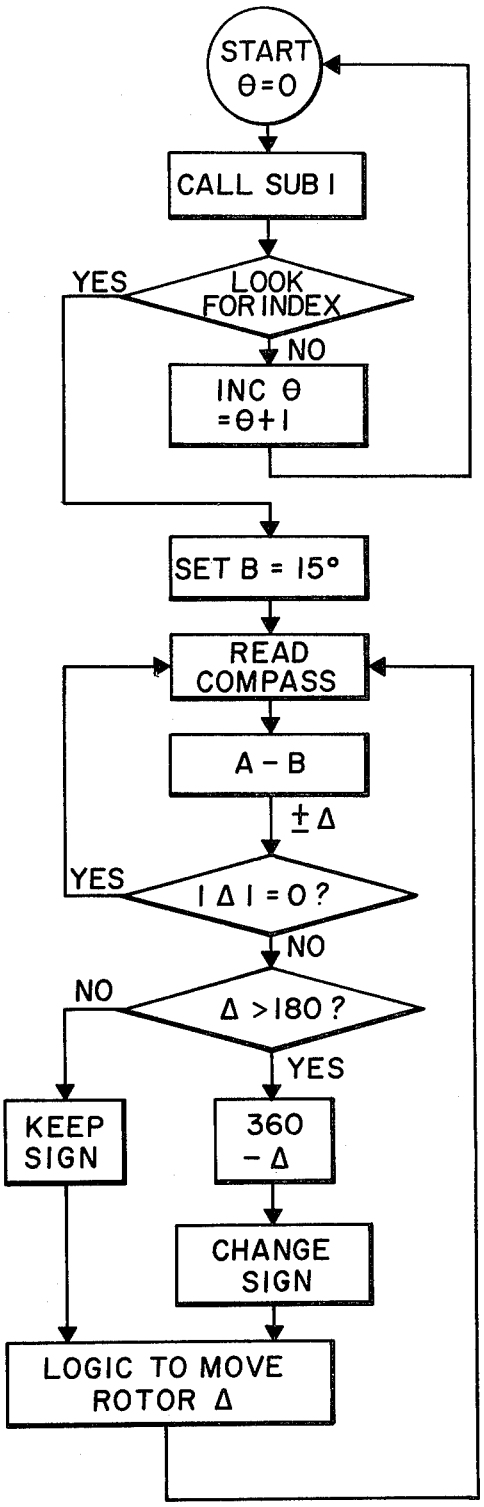
FIG. 4 is a flow diagram showing the operation of preferred logical selection circuitry for elimination of ambiguity in the multiple magnet embodiment of FIG. 3.

As shown in FIG. 4, the electronic processing used in conjunction with the embodiment of FIG. 3 is specifically adapted to eliminate this 0°–180° ambiguity.

Using the processing shown in FIG. 4 as Subroutine 1, the microprocessor slews the rotor around until the index magnet passes the reed switch producing an index signal.

When the index signal is detected, the microprocessor reads the angular input signal A and calculates the difference D=A-B. If D is zero, no change in position is required and the program takes a new reading. If D is not zero, the microprocessor inquires whether the absolute value of D is greater than 180°. If it is not, the sign of D is retained. If it is, D is subtracted from 360° and the sign is changed. In either case, the result is then fed into logic circuitry to move the rotor by the differential angle thus calculated, clockwise for positive values and counterclockwise for negative values.

While the invention has been described in connection with a small number of specific embodiments, it is to be understood that these are merely illustrative of the many other specific embodiments which can also utilize the principles of the invention.

What is claimed is:

1. A remote indicator for displaying data contained in a transmitted signal by angular displacement of a rotor comprising:

a rotably mounted magnetic rotor;

a plurality of controllable magnetic field generating means disposed circumferentially around said rotor; and selection circuitry responsive to said data for sequentially activating alternately each of a plurality of said magnetic field generating means for effectively displacing said rotor substantially to an angle representative of the value of said data, wherein said selection circuitry comprises sector selection circuit means for selectively enabling at proper polarity a pair of said generating means appropriate for controlling said rotor within a sector representative of such data and angle selection circuit means for sequentially driving the selected generating means by electrical pulses modulated to drive the rotor within said sector to said angle representative of such data, wherein said angle selection circuit means comprises memory means for storing for each of a plurality of angles within said sector timing data for the duration of electrical pulses to be applied to said selected magnetic field generating means to displace said rotor to said respective angles.

2. A remote indicator according to claim 1 wherein said magnetic field generating means are sequentially driven at a rate in excess of about 10 hertz.

3. A remote indicator for displaying data contained in a transmited signal by angular displacement of a rotor, comprising:

a rotatably mounted magnetic rotor;

a plurality of controllable magnetic field generating means disposed circumferentially around said rotor; and, selection circuitry responsive to such data for sequentially activating alternately each of a plurality of said magnetic filed generating means for effectively displacing said rotor substantially to an angle representative of the value of said data, wherein said selection circuitry comprises sector selection circuit means for selectively enabling at proper polarity a pair of said generating means appropriate for controlling said rotor within a sector representative of such data and angle selection circuit means for sequentially driving the selected generating means by electrical pulses modulated to drive the rotor within said sector to said angle representative of such data, wherein said angle selection circuit means comprises memory means for storing for each of a plurality of angles within said sector requiring low values of energization for one or more of magnetic field generating means, command data effecting AC energization of said one or more magnetic field generating means.

4. A remote indicator according to claim 3 wherein said magnetic field generating means are sequentially driven at a rate in excess of about 10 hertz.

5. A remote indicator for displaying data in a transmitted signal by angular displacement of a rotor, comprising:

a rotatably mounted magnetic rotor;

a plurality of controllable pairs of magnetic field generating means, each pair comprising:

a core of magnetically permeable material having opposing core end faces disposed circumferentially about the rotor;

coils disposed about the ends of said cores, said coils in series connected relationship and establishing a center tap connection and non-center tap coil ends;

a positive voltage being applied to the center tap connection of the series connected coils; and switch means for selectively grounding non-center tap ends of said coils inducing a magnetic field direction within said magnetically permeable core;

selection circuitry responsive to such data for sequentially activating said opposing pairs of magnetic field generating means for effectively displacing said rotor substantially to an angle representative of the value of said data, wherein said selection circuitry comprises sector selection circuit means for selectively enabling at proper polarity a pair of generating means via said switch means appropriate for controlling said rotor within a sector representative of such data and angle selection circuit means for sequentially driving the selected generating means by electrical pulses time modulated to drive the rotor within said sector to said angle representative of such data.

6. A remote indicator according to claim 5 wherein said magnetic field generating means are sequentially driven at a rate in excess of about 10 hertz.

7. A remote indicator according to claim 5 wherein the plurality of controllable pairs of magnetic field generating means comprise two magnetically permeable cores having first and second orthogonal axes through said opposing core faces.

* * * * *

UNITED STATES PATENT AND TRADEMARK OFFICE

CERTIFICATE OF CORRECTION

PATENT NO. : 4,443,795

DATED : April 17, 1984

INVENTOR(S) : John T. Fowler

It is certified that error appears in the above—identified patent and that said Letters Patent is hereby corrected as shown below:

Column 1, line 26, "leading" should read --heading--.

Column 2, line 53, "11C" should read --11B--.

Column 5, line 57, "filed" should read --field--.

Signed and Sealed this

*Fifteenth* Day of *January 1985*

[SEAL]

*Attest:*

*Attesting Officer*

GERALD J. MOSSINGHOFF

*Commissioner of Patents and Trademarks*